US006910407B2

(12) United States Patent
Furuta

(10) Patent No.: US 6,910,407 B2
(45) Date of Patent: Jun. 28, 2005

(54) FUEL INJECTION PUMP

(75) Inventor: Katsunori Furuta, Nagoya (JP)

(73) Assignee: Denso Corporation (JP)

( * ) Notice: Subject to any disclaimer, the term of this patent is extended or adjusted under 35 U.S.C. 154(b) by 66 days.

(21) Appl. No.: 10/173,800

(22) Filed: Jun. 19, 2002

(65) Prior Publication Data

US 2002/0189438 A1 Dec. 19, 2002

(30) Foreign Application Priority Data

Jun. 19, 2001 (JP) ..... 2001-184957
Jan. 11, 2002 (JP) ..... 2002-005026

(51) Int. Cl.[7] ..... F01B 1/00
(52) U.S. Cl. ..... 92/72; 92/129
(58) Field of Search ..... 92/72, 129

(56) References Cited

U.S. PATENT DOCUMENTS 3,036,557 A * 5/1962 Kimsey ..... 92/72
3,628,425 A * 12/1971 Morita et al. ..... 92/72
6,077,056 A 6/2000 Gmelin
6,289,875 B1 * 9/2001 Shinohara et al. ..... 123/450
6,350,107 B1 * 2/2002 Hamutcu ..... 92/72

* cited by examiner

*Primary Examiner*—F. Daniel Lopez
(74) *Attorney, Agent, or Firm*—Nixon & Vanderhye PC

(57) ABSTRACT

In a fuel injection pump, a tappet is provided on an end thereof on a side of a cam ring with a hollow. Force acting on the tappet from a plunger due to fuel pressure is dispersed to a sliding contact surface outside the hollow so that contact face pressure between the tappet and the cam ring is smaller. As the fuel pressure becomes higher, larger resilient deformation of the tappet causes a diameter of the hollow smaller so that the tappet comes in flat slidable contact with the cam ring, resulting in preventing the contact portion between the tappet and the cam ring from being seized with frictional heat.

2 Claims, 8 Drawing Sheets

FUEL INJECTION PUMP

CROSS REFERENCE TO RELATED APPLICATION

This application is based upon and claims the benefit of priority of Japanese Patent Applications No. 2001-184957 filed on Jun. 19, 2001 and No. 2002-5026 filed on Jan. 11, 2002, the contents of which are incorporated herein by reference.

BACKGROUND OF THE INVENTION

1. Field of the Invention

The present invention relates to a fuel injection pump for internal combustion engines (hereinafter called engines), in particular, a high pressure pump having a plunger to be reciprocatingly driven by an eccentric cam.

2. Description of Related Art

In a conventional high pressure pump, a plunger is axially and reciprocatingly driven via a cam ring by a cam for transmitting a driving force. The cam is eccentrically mounted on a drive shaft and the cam ring revolves round the drive shaft without self-rotating according to rotation of the drive shaft. The reciprocating motion of the plunger causes to suck and compress fuel in and to discharge the same from a fuel compression chamber.

Higher injection pressure of the fuel is recently demanded to obtain higher output and lower exhaust emission of the engine.

However, to secure the higher injection pressure of the fuel, it is necessary to increase a force with which the fuel injection pump compresses the fuel so that the load of the fuel injection is very high. In particular, when higher force is applied to contact portions of the fuel injection pump in slidable contact with each other, the contact portions tend to be seized with frictional heat.

For example, a drive force transmission member, in which the plunger for compressing the fuel is accommodated, is in slidable contact with the cam ring and moves recirocatingly, while moving relative to the cam ring. When the fuel is press delivered, the plunger receives greater force due to fuel compressed in the fuel compression chamber so that the plunger is pressed toward the drive force transmission member. The force acting on the plunger urges the drive force transmission member toward the cam ring since the plunger is accommodated inside the drive force transmission member. As the pressure of fuel becomes higher, the force applied from the plunger to the drive force transmission member is more increased.

The force applied from the plunger to the drive force transmission member concentrates on a center of the drive force transmission member in contact with the plunger. Accordingly, the center of the drive force transmission member is resiliently deformed to protrude toward the cam ring. As a result, large face pressure is produced on a slidable contact portion between the protruding portion of the drive force transmission member due to the resilient deformation thereof and the cam ring so that the slidable contact portion tends to be seized with frictional heat.

Further, the force acting on the plunger is applied to the cam ring through the drive force transmission member so that the cam ring is resiliently deformed to cause inner circumference thereof to protrude toward the drive shaft. Accordingly, larger face pressure is locally produced on a slidable contact portion between the inner circumference of the cam ring and an outer circumference of the cam to an extent that the-slidable contact portion tends to be seized with frictional heat.

SUMMARY OF THE INVENTION

An object of the present invention is to provide a fuel injection pump whose construction is simpler and enables to deliver high pressure fuel and whose slidable contact portions are hardly seized with frictional heat.

To achieve the above object, the fuel injection pump has a drive shaft driven by an internal combustion engine, an eccentric cam rotatable together with the drive shaft, a cam ring member whose inner circumferential face is in slidable contact with an outer circumferential face of the eccentric cam, acylinder, and a plunger member slidably housed in the cylinder. An axial end face of the plunger member is in slidable contact with an outer circumferential face of the cam ring member and fuel is sucked and compressed in the cylinder on a side of the other axial end of the plunger according to a reciprocating movement of the plunger member caused by a transmitting force from the drive shaft via the eccentric cam and the cam ring member.

With the pump mentioned above, the plunger member or the cam ring member is provided on an axial center line of the plunger member with a hollow whose depth is gradually deeper from an outer periphery to a center thereof in an axial direction of the cam ring member so that the transmitting force skirts around the hollow and diameter of the hollow becomes smaller due to resilient deformation thereof as the transmitting force becomes stronger.

Accordingly, contact pressure between the plunger and cam ring members and contact pressure between the cam ring member and the eccentric cam are higher at a position away from the axial center line of the plunger member, when the transmitting force is low, but, as the transmitting force becomes stronger, is equalized between the positions away from and closer to the axial center line of the plunger member since the diameter of the hollow becomes smaller due to resilient deformation of the plunger or cam ring member. Since high pressure does not concentrate on the axial center line of the plunger member, the hollow serves to prevent the sliding contact portions between the plunger and cam ring members from being seized with frictional heat.

It is preferable that the plunger member comprises a plunger slidably housed in the cylinder and a drive force transmission member whose end face is in slidable contact with an outer circumferential face of the cam ring member, whose another end face retains and in contact with an axial end of the plunger, and whose diameter is larger than that of the axial end of the plunger.

It is preferable that the end face of the drive force transmission member has the follow and is outside the hollow in slidable contact with the outer circumferential face of the cam ring member.

As an alternative, the end face of the drive force transmission member has the follow and retains the shoe in contact therewith outside the hollow so that the shoe is in slidable contact with the outer circumferential face of the cam ring member.

As a further alternative, the inner circumferential face of the cam ring member may have the hollow and be outside the hollow in slidable contact with the outer circumference of the eccentric cam, or, the outer circumferential face of the cam ring member may have the hollow and be outside the hollow in slidable contact with the end face of the drive force transmission member.

As a still further alternative, in a case that the cam ring member comprises a cam ring and a ring bush, outer circumference of the cam ring is in slidable contact with the end face of the drive force transmission member and inner circumference thereof is provided with the hollow and outer circumference of the ring shaped bush is in contact with the inner circumference of the cam ring outside the hollow and inner circumference thereof is in slidable contact with the outer circumference of the eccentric cam.

Further, outer circumference of the cam ring is provided with the hollow and is outside the hollow in slidable contact with the end face of the drive force transmission member and outer circumference of the ring shaped bush is in contact with an inner circumference of the cam ring and inner circumference thereof is in slidable contact with the outer circumference of the eccentric cam.

Preferably, the diameter of the hollow is larger than that of the axial end of the plunger, but, more preferably, smaller than that of the drive force transmission member, when the transmitting force is not applied. In this case, the transmitting force by passes a larger are a outside diameter of the axial end of the plunger at an initial stage so that each of the contact pressure between the plunger member (the drive force transmission member or the shoe) and the cam ring member and the contact pressure between the cam ring member (the ring bush) and the eccentric cam is more widely dispersed and higher at the position more away from the axial center line of the plunger. However, as the transmitting force becomes stronger, the transmitting force bypasses a smaller area within the diameter of the axial end of the plunger so that the contact pressure is equalized between the outside and inside of the diameter of the axial end of the plunger. Since the contact pressure does not concentrate on the axial center line of the plunger, the sliding contact among the plunger member, cam ring member and the eccentric cam hardly produces frictional heat seizure.

Further, the plunger and the drive force transmission member may be formed into an integrated body.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

A fuel injection pump for a diesel engine according to a first preferred embodiment of the present invention is described with reference to FIGS. 1 to 5.

Figure 2:
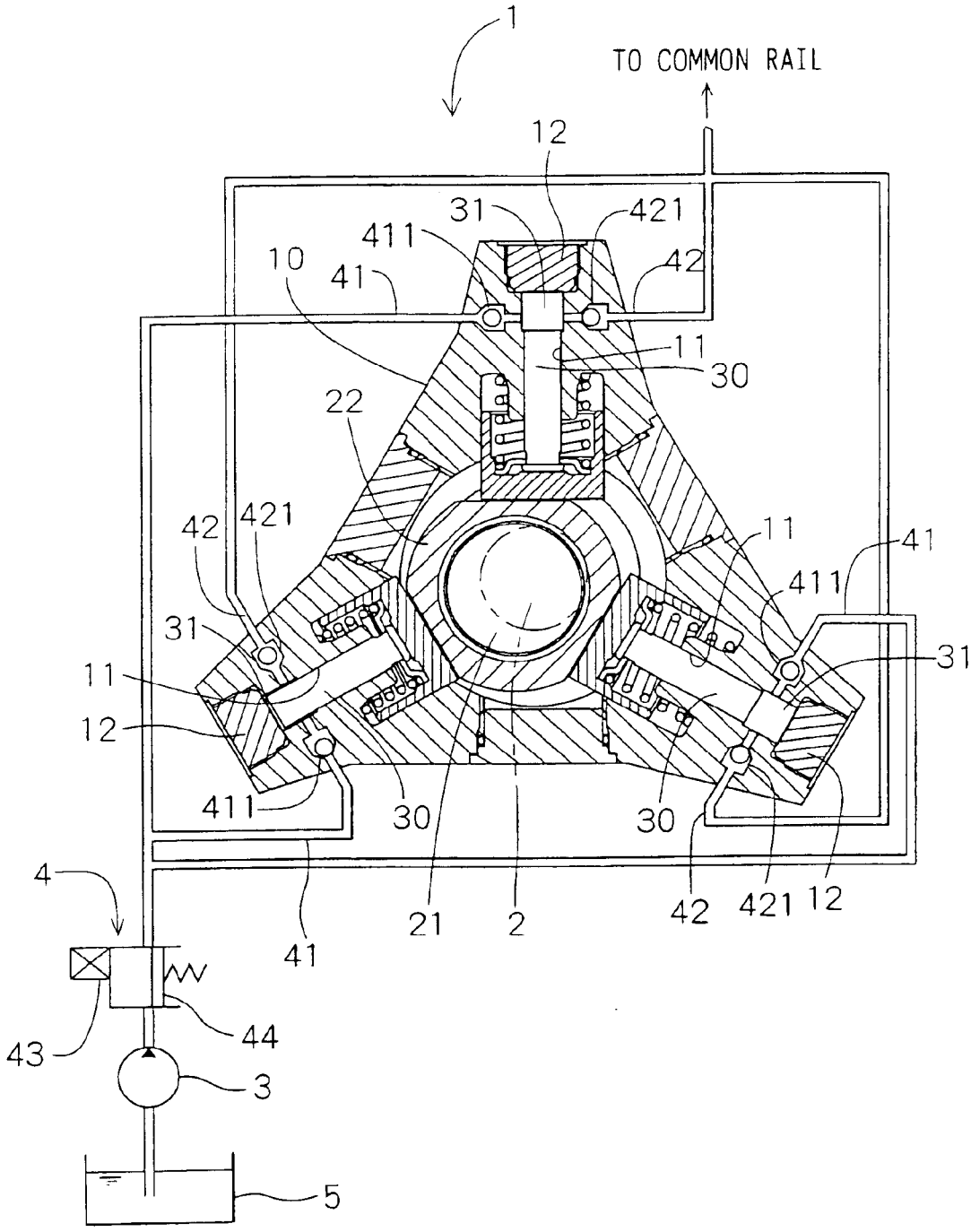
FIG. 2 is a cross sectional entire view of the fuel injection pump according to the first embodiment.

As shown in FIG. 2, the fuel injection pump 1 for the diesel engine is a radial type pump in which three movable members are arranged around a drive shaft 2 circumferentially at 120° intervals. The drive shaft 2 is rotatably held by a pump housing 10 via a bearing and a journal (both not shown). The drive shaft 2 is provided integrally with an eccentric cam 21. An outer circumference of the cam 12 is fitted to an inner circumference of a ring shaped cam ring 22.

A plunger 30 as one of the movable members is slidably and recirocatingly housed in a cylinder 11 provided in the pump housing 10. An opening of the cylinder 11 is closed by a sealing plug 12. Inside of the cylinder 11 on a side of the sealing plug constitutes a fuel compression chamber 31.

The fuel compression chamber 31 is formed by an inner wall of the pump housing, an axial end of the plunger on a side opposite to the drive shaft 2 and an end face of the sealing plug 12 on a side of the drive shaft 2. The fuel compression chamber 31 communicates with a fuel intake conduit 41 and with a fuel discharge conduit 42. Non-return valves 411 and 421, which prevent fuel from flowing in opposite directions to fuel intake and discharge directions, are arranged in the fuel intake and discharge conduits 411 and 421, respectively.

As shown in FIG. 2, the fuel intake conduit 41 is branched out at a position downstream a fuel regulation valve 4 arranged downstream a feed pump 3 into three conduits each of which communicates with each fuel compression chamber 31. The fuel regulation valve 4 is an electromagnetic valve that regulates an amount of fuel to be sucked from a fuel tank 5 via the feed pump 3 to the fuel compression chamber 31 according to engine operating conditions. The fuel regulation valve 4 has a solenoid 43 and a valve body 44. An opening of the valve body 44 is controlled by adjusting a value of control current to be applied to the solenoid 43 for regulating the amount of fuel to be sucked to the fuel compression chamber 31. The fuel pressurized in the fuel compression chamber 31 is discharged via the non-return valve 421 and the fuel discharge conduit 42 to a common rail (not shown). The common rail serves to accumulate the fuel supplied with variable pressure from the fuel injection pump 1 and holds the fuel with a given pressure. Then, the high pressure fuel is delivered to injectors (not shown) from the common rail.

The movable members has the plunger 30, a tappet 32 as a drive force transmission member and a lower sheet 33. The plunger is slidably and reciprocatingly held in the cylinder 11 provided in the pump housing 10.

Figure 3:
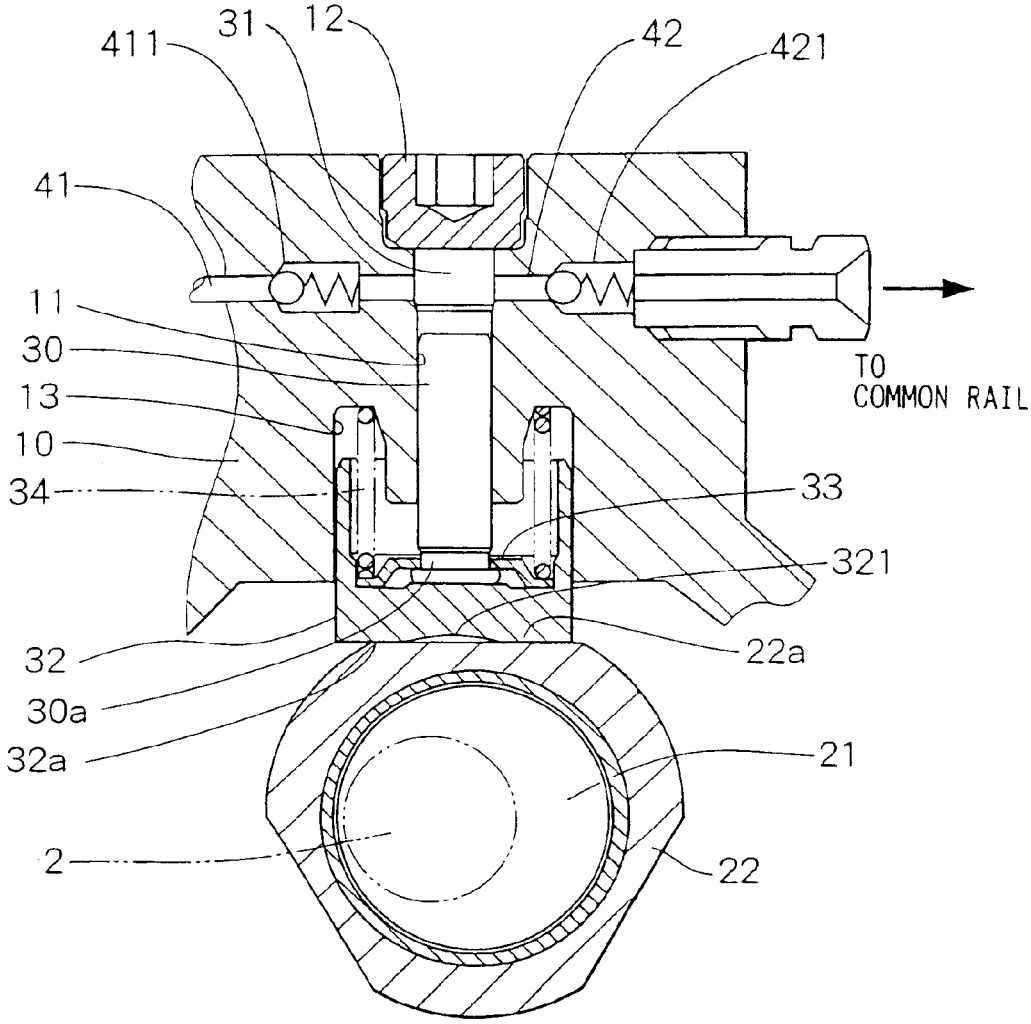
FIG. 3 is a cross sectional part view of the fuel injection pump according to the first embodiment.

As shown in FIG. 3, the plunger 30 is biased toward the tappet 32 by a spring 34 via the lower sheet 33 fitted to a small diameter portion 30*a*. The plunger 30 makes reciprocating movement via the cam 21, the cam ring and the tappet 32 according to rotation of the drive shaft 2. When the plunger 30 moves downward toward the drive shaft 2, the fuel is sucked into the fuel compression chamber 31 via the fuel intake conduit 41. When the plunger 30 moves upward in a direction opposite to the drive shaft 2, the fuel is discharged from the fuel discharge conduit 42.

The tappet 32 is slidably and reciprocatingly held in a housing bore 13 that is provided in the pump housing 10 circumferentially outside the cylinder 11.

Figure 1:
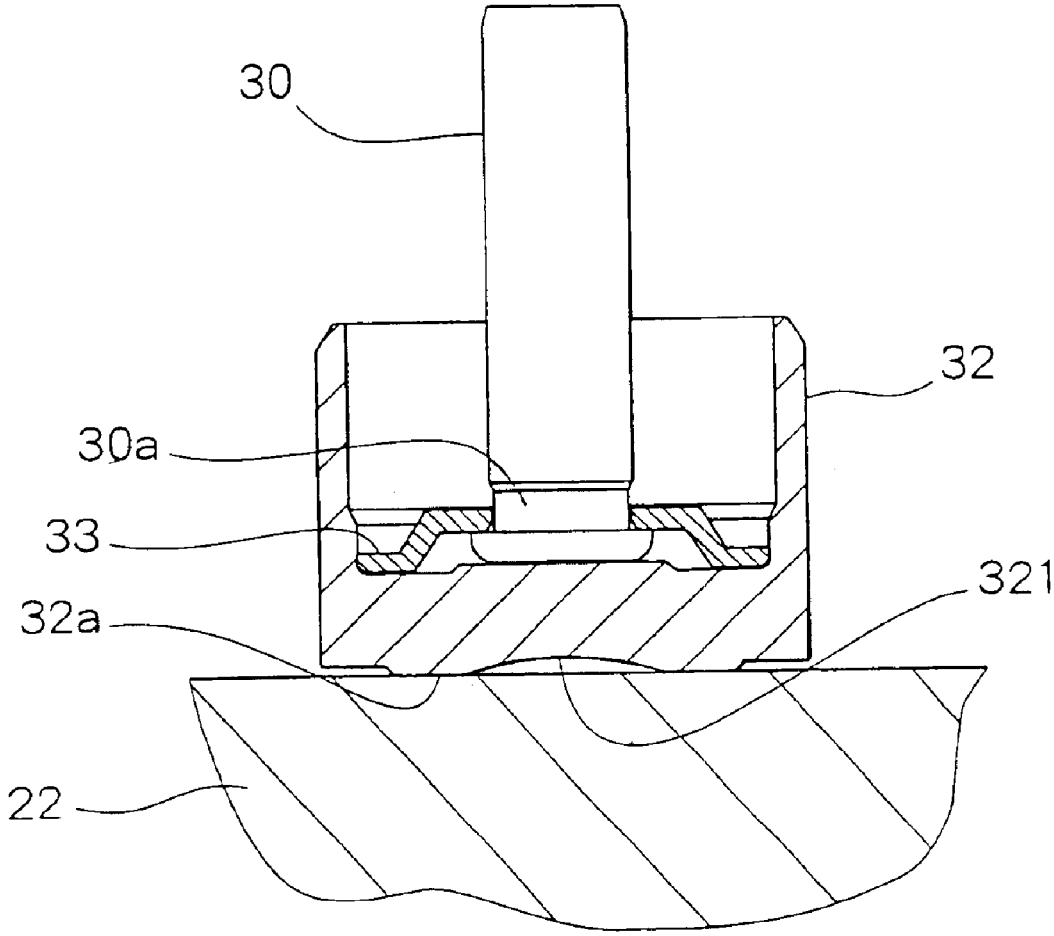
FIG. 1 is a partly enlarged cross sectional view of a fuel injection pump according to a first embodiment of the present invention.

The tappet 32 is provided at an end thereof on a side of the cam ring 22 with a sliding face 32*a* in slidabe contact with the cam ring 22. The sliding face 32*a* of the tappet 32 slidably contacts and reciprocatingly moves in left and right directions in FIG. 3 relative to a sliding face 22*a* of the cam ring 22. As shown in FIG. 1, the tappet 32 is provided at an end on a side of the cam ring 22 with a hollow 321 and surrounding outside the hollow 321, that is, outside outer periphery of the hollow 321 constitutes the sliding face 32*a*.

Figure 4:
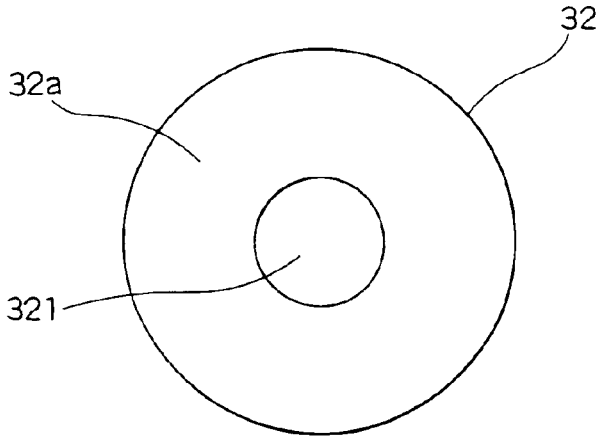
FIG. 4 is a schematic plan view of a tappet of the fuel injection pump as viewed from a side of a cam ring according to the first embodiment of the present invention.

The hollow 321 is formed in round shape, as shown in FIG. 4, and depth of the hollow 321 is deeper from the outer periphery toward the center thereof. The center of the hollow 321 whose depth is deepest is positioned on an axial center of the plunger 30. Bottom of the hollow 321 is formed in a relatively gentle curve. Further, a boundary between the hollow 321 and the sliding face 32*a* is rounded with a gentle curve and a line of the boundary is vague, though the boundary is shown in a solid line in FIG. 4 for a sake of brevity. Since both of the boundary between the hollow 321 and the sliding face 32*a* and the bottom of the hollow 321 are formed in a gentle curve, there exist no acute edges on the end face of the tappet 32 that faces the sliding face 22*a* of the cam ring 22.

Figure 5:
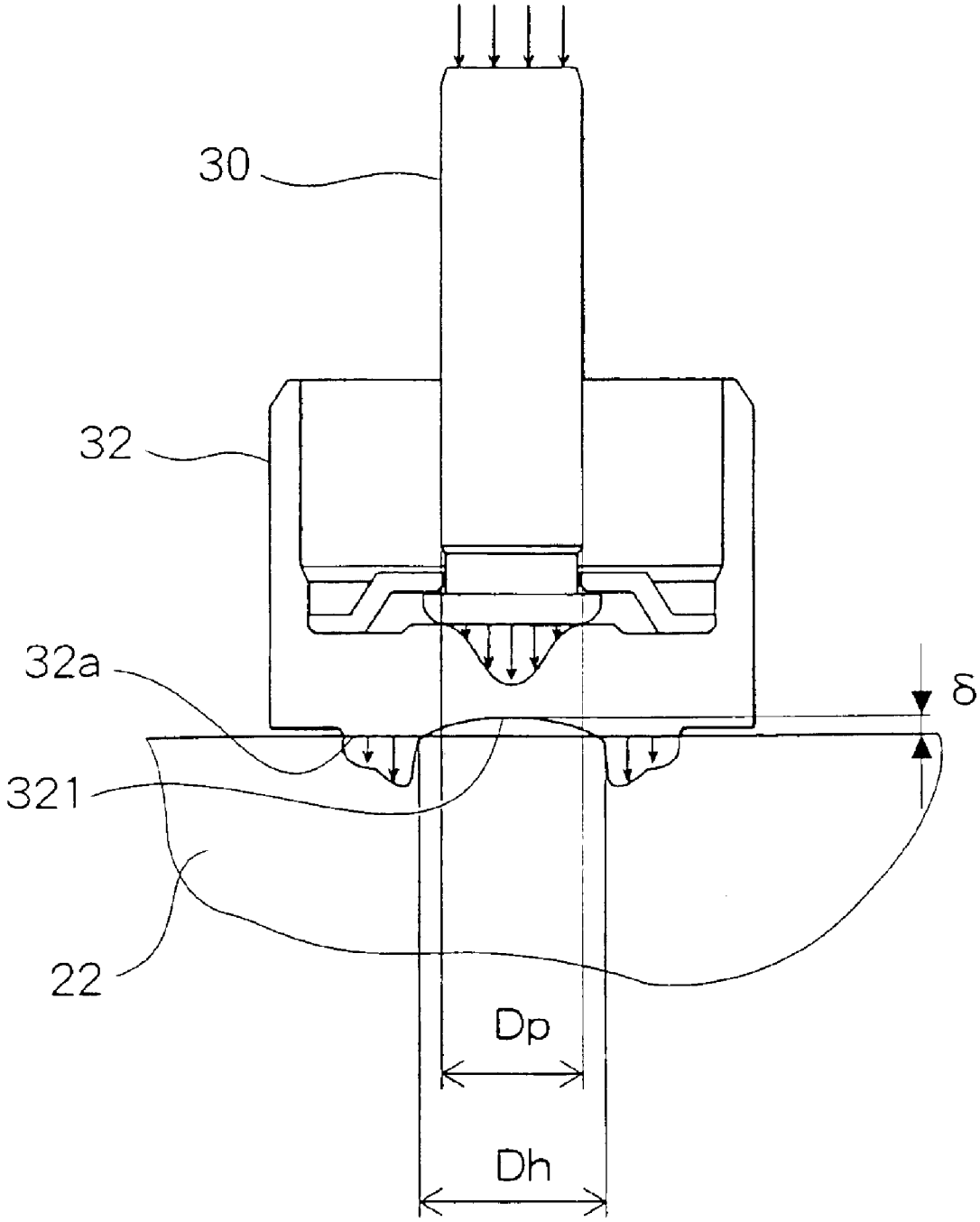
FIG. 5 is a partly enlarged cross sectional schematic view of the fuel injection pump on which transmitting force acts according to first embodiment.

As shown in FIG. 5, Diameter Dh of the hollow 321 is larger than diameter Dp of the plunger. Depth δ of the hollow 321, that is, a distance between the sliding face 32*a* and the bottom of the hollow 321, can be set to a given value according to an amount of resilient deformation of the tappet 32 due to fuel pressure applied to the plunger 30, and in the first embodiment, is set to 1 μm to 1.5 μm.

Next, an advantage of providing the hollow 321 for reducing face pressure is described in comparison with the conventional fuel pump.

Figure 6:
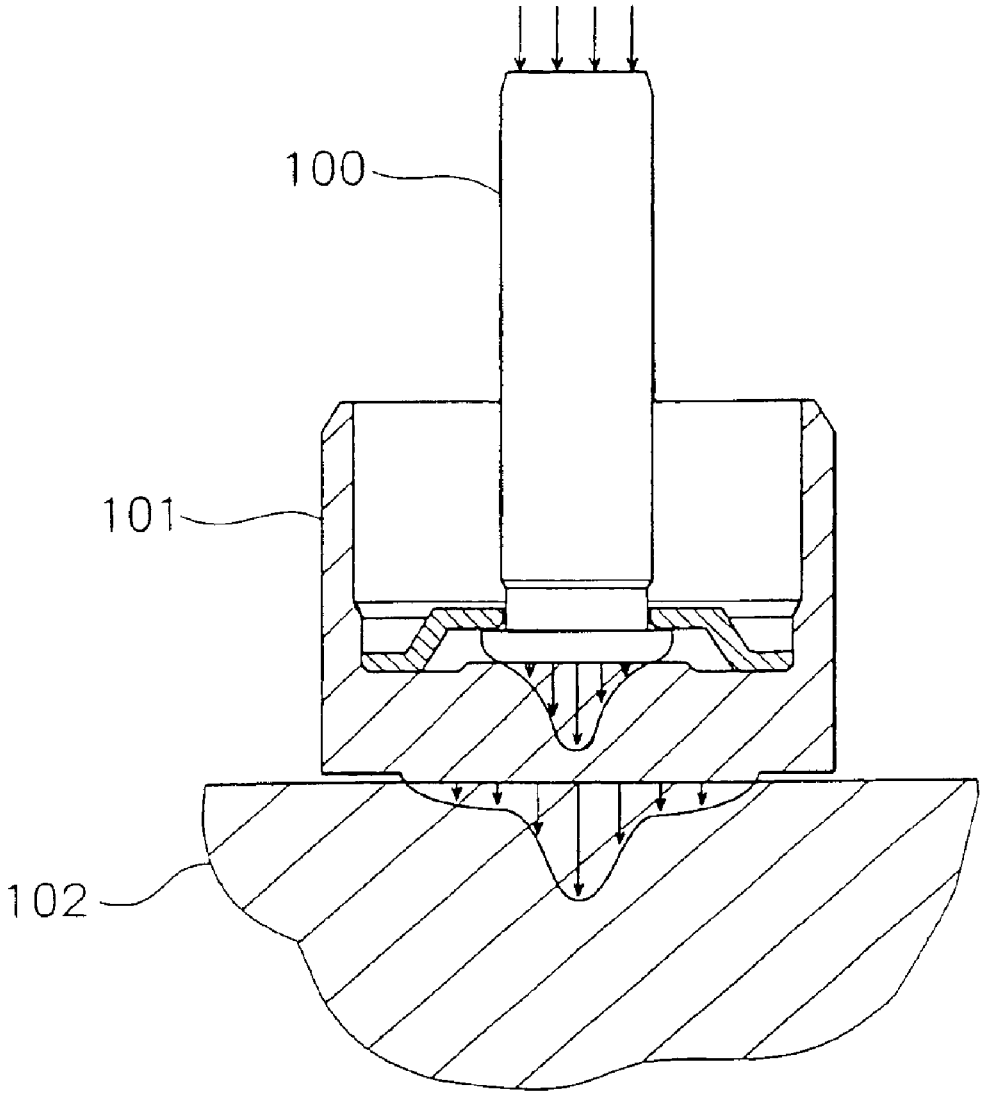
FIG. 6 PRIOR ART
FIG. 6 is a partly enlarged cross sectional schematic view of a conventional fuel injection pump as a prior art.

FIG. 6 shows a part of the conventional fuel injection pump whose tappet is not provided with the hollow for a purpose of comparison. Arrow marks shown in FIGS. 5 and 6 illustrate schematically direction and magnitude of forces acting on the plunger, the tappet and the cam ring.

As shown in FIG. 6, the plunger 100 exerts force acting on the tappet 101 since the fuel pressure is applied to plunger 100. The force applied from the plunger 100 to the tappet 101 is larger toward the axial center of the plunger 100 and shows a distribution pattern as shown in FIG. 6. That is, the tappet 101 receives the force intensively on an axial center line of the plunger 100 so that the tappet 101 is urged toward a cam ring 102 and a sliding contact portion between the tappet 101 and the cam ring 102 receives force intensively on the axial center line of the plunger 100, as shown in FIG. 6. The tappet 101 is resiliently deformed in a manner that the center of the tappet 101 protrudes toward the cam ring 102 and the tappet 101 slides on the cam ring 102 under high contact pressure since a part of the tappet on the axial center line of the plunger 100 receives the maximum force. Accordingly, the protruding center portion of the tappet 101 is likely seized with frictional heat.

In the first embodiment, as shown in FIG. 5, the bottom of the hollow 321 and the cam ring 22 are not in contact with each other and the sliding face 32*a* outside the hollow 321 and the cam ring 22 are in contact with each other, when the fuel pressure is relatively low and the resilient deformation is relatively small. Accordingly, the sliding face 32*a* slides on the sliding face 22*a* and the force applied to the plunger 30 bypasses radially the hollow 321 and is dispersed to the sliding face 32*a* outside the hollow 321 so that an area of the cam ring 22 to which the force is applied from the tappet 32 is larger and a face pressure (pressure per unit area) due to slidable contact between the tappet 32 and the cam ring 22 is smaller, compared with that of the conventional fuel injection pump.

As the fuel pressure applied to the plunger 30 becomes higher, the amount of resilient deformation of the tappet 32 becomes larger, so the bottom of the hollow 321 comes in contact with the cam ring 22 in such a manner that the contact area of the bottom gradually increases from a side of the outer periphery thereof to a side of the center thereof since the force from the plunger 30 is applied to the tappet 32 on the axial center line of the plunger 30. That is, as the fuel pressure becomes higher, the diameter of the hollow 321 becomes smaller. If the depth δ of the hollow 321 is set to an adequate value responsive to the amount of resilient deformation of the tappet 32, the end face of the tappet 32 on a side of the cam ring 22 becomes a substantially flat surface when the fuel pressure shows maximum value. Accordingly, the tappet 32 comes in substantially flat surface contact with the cam ring 22 so that local frictional heat seizure hardly occurs.

(Second Embodiment)

A fuel injection pump according to a second embodiment is described with reference to FIG. 7. Arrow marks shown in FIG. 7 illustrate schematically direction and magnitude of forces acting on the plunger and the cam ring.

The fuel injection pump 1 according to the second embodiment differs from that of the first embodiment in such a point that a tappet 50 is provided on a side of the cam ring with a shoe 60 as the drive force transmission member.

Figure 7:
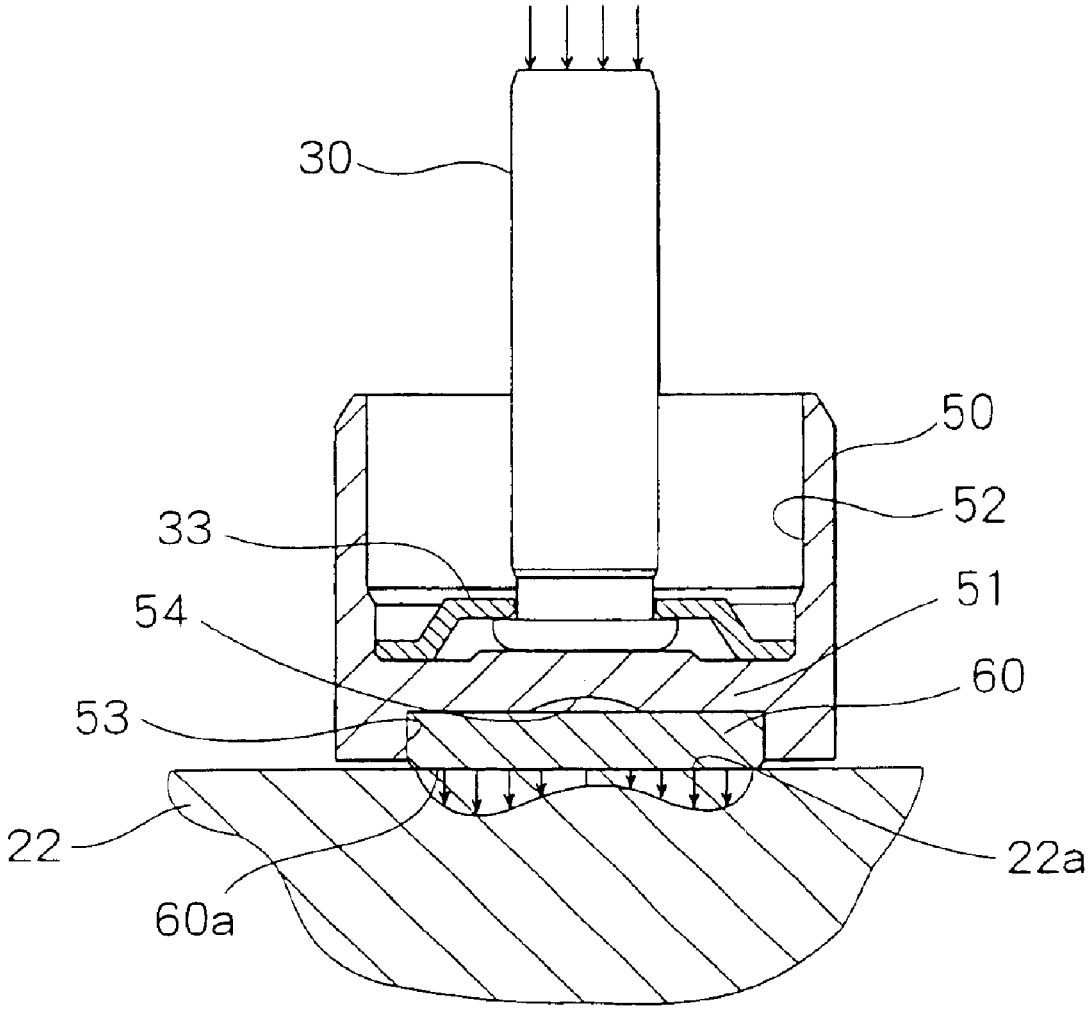
FIG. 7 is a partly enlarged cross sectional view of a fuel injection pump according to a second embodiment of the present invention.

As shown in FIG. 7, the tappet 50, whose cross section is formed in a letter H shape, is cylindrical and has two inside spaces 52 and 53 that are divided by a partition 51. The plunger 30 is accommodated in the inside space 52 on a side opposite to the cam ring 22 so as to be in contact with the partition 51. The shoe 60 is press fitted to the inside space 53 on a side of the cam ring 22. The shoe 60 is formed in a column shape and made of high hardness material. The shoe 60 is provided with a sliding face 60*a* that is in sliding contact with the sliding face 22*a* of the cam ring 22.

The partition 51 is provided at a surface on side of the shoe 60 with a hollow 54. Depth and diameter of the hollow 54 are same as those of the first embodiment. The force applied to the plunger 30 bypasses radially the hollow 54 in the partition 51, that is, is dispersed to the shoe 60 via the surrounding outside the hollow 54 in the partition 51 so that an area of the cam ring 22 to which the force is applied from the shoe 60 is larger and pressure of the sliding contact portions between the shoe 60 and the cam ring 22 is smaller in the axial center line of the plunger 30, as shown as a pressure pattern in FIG. 7.

According to the second embodiment, since the surface of the partition 51 on side of the shoe 60 has the hollow 54, a face pressure (pressure per unit area) due to slidable contact between the shoe 60 and the cam ring 22 is smaller. Further, since the hollow 54 is provided in the partition 51, not in an end face of the shoe 60 on a side of the cam ring 22, the shoe 60 and the cam ring 22 are in flat surface contact with each other and contact pressure therebetween is more equalized, as the fuel pressure becomes higher, resulting in less local frictional heat seizure.

(Third Embodiment)

Figure 8:
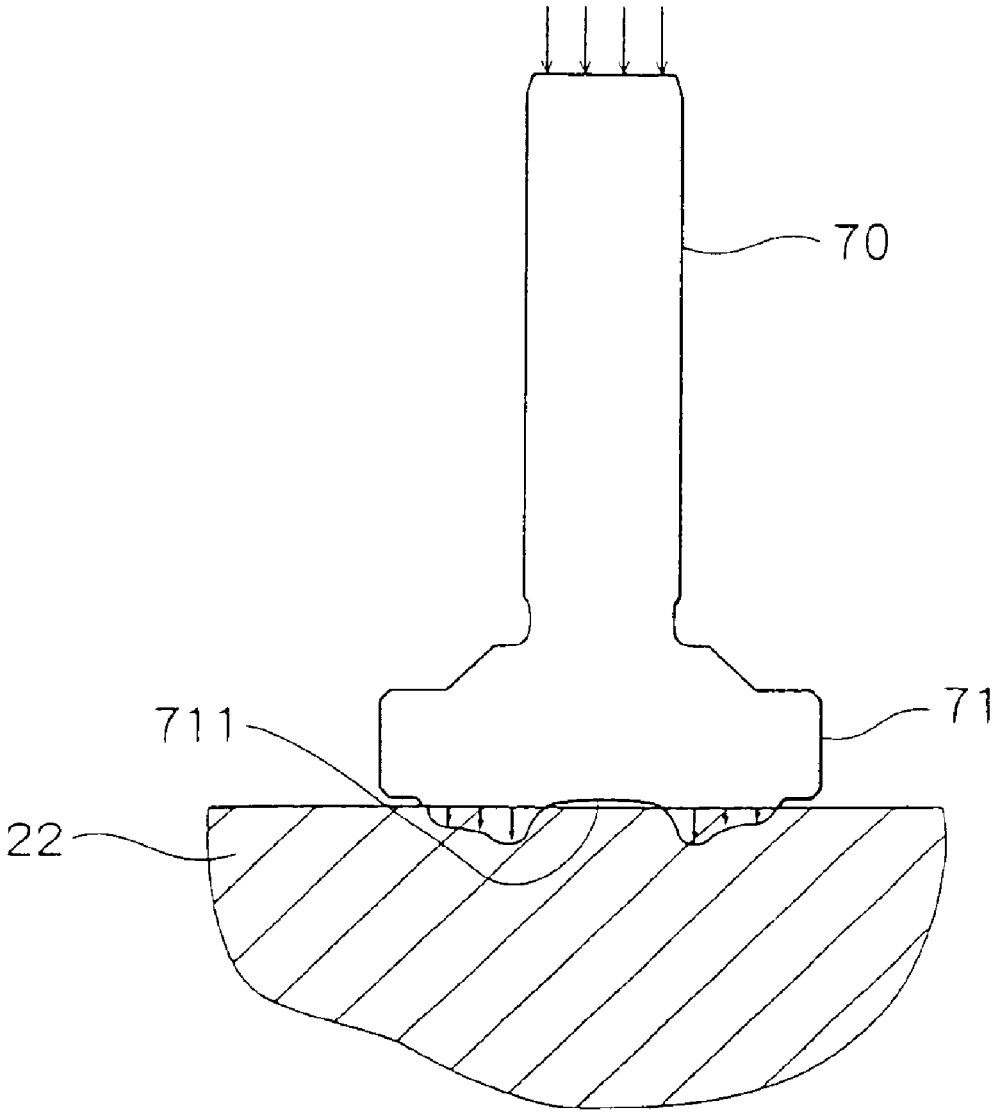
FIG. 8 is a partly enlarged cross sectional view of a fuel injection pump according to a third embodiment of the present invention.

A fuel injection pump according to a third embodiment is described with reference to FIG. 8. Arrow marks shown in FIG. 8 illustrate schematically direction and magnitude of forces acting on the plunger and the cam ring.

The fuel injection pump 1 according to the third embodiment differs from that of the first embodiment in such a point that a plunger 70 and a plunger head 71 as the drive force transmission member are formed into an integrated body, that is, integrally formed with same material. The plunger head 71 is in slidable contact with the cam ring 22.

The plunger head 71 is provided at an end thereof on a side of the cam ring 22 with a hollow 711. Depth and diameter of the hollow 711 are same as those of the first embodiment. Similarly to the first embodiment, the force applied to the plunger 70 is dispersed to the surrounding outside the hollow 711 in the plunger head 71, resulting in less local frictional heat seizure.

According to the third embodiment, the plunger 70 and the plunger head 71 are integrally formed, which enables to manufacture a less number of component parts of the fuel injection pump 1.

(Fourth Embodiment)

Figure 9A:
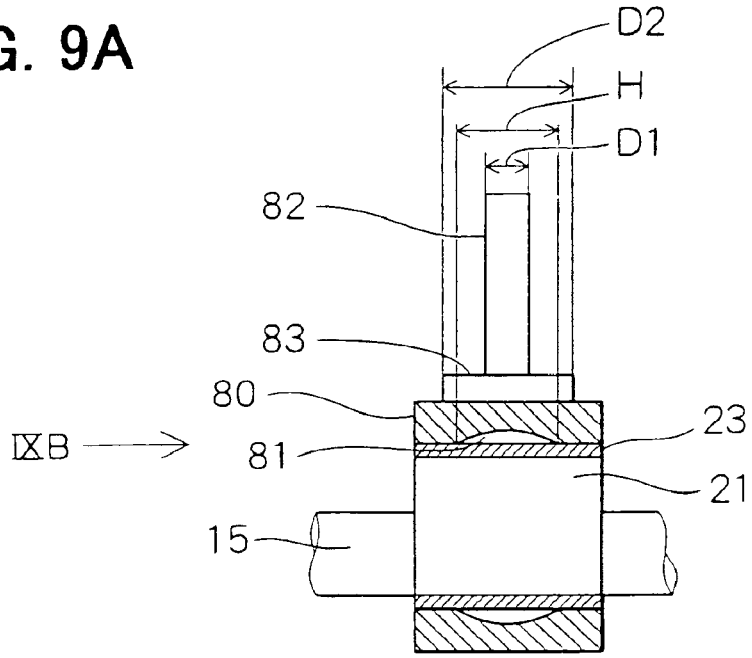
FIG. 9A is a partly enlarged cross sectional view of a fuel injection pump according to a fourth embodiment of the present invention.
Figure 9B:
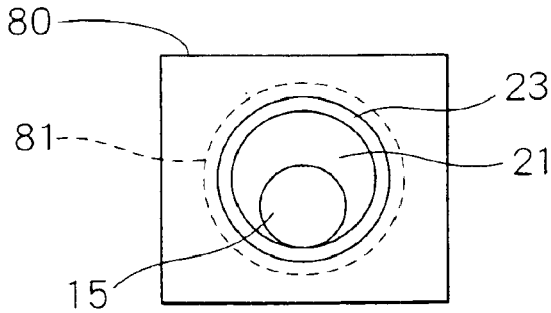
FIG. 9B is a view of the fuel injection pump in FIG. 9A as viewed from an arrow IXA.

A fuel injection pump according to a fourth embodiment is described with reference to FIGS. 9A and 9B.

According to the fourth embodiment, a cam ring 80 is provided on an inner circumferential face thereof with a hollow 81. The hollow 81 is formed in shape of a ring groove along the inner circumferential face of the cam ring 80, as shown in FIG. 9B. Depth of the hollow 81 as viewed in a cross section of the cam ring 80 taken along an axial line thereof is deeper from an outer periphery thereof toward a center thereof and the center of the hollow 81 is positioned on an axial line of a plunger 82, as shown in FIG. 9A. The plunger 82 and a tappet 83 constituting the drive force transmission member are integrally formed. As an alternative, the plunger 82 may be formed separately from the tappet 83, similarly to the first embodiment. The plunger 82 and the tappet 83, whether or not they are integrated or separated, constitute a plunger member.

A bush 23 is inserted between the inner circumferential face of the cam ring 80 and an outer circumference of the cam 21. The bush 80 is press fitted to the inner circumferential face of the cam ring 80. An inner circumferential wall of the bush is in slidable contact with the outer circumference of the cam 21. Assuming that length of the hollow 81 in the axial direction of the cam ring 80 is H, outer diameter of the plunger 82 is $D_1$ and outer diameter of the tappet is $D_2$, the length of the hollow 81 (Diameter of the hollow 81) H is set to a value which falls within a range, $D_1<H<D_2$.

When the fuel pressure of the fuel compression chamber 31 is applied to the plunger 82, the tappet 83 is resiliently deformed. That is, a part of the tappet 83 to which force is applied from the plunger 82 is resiliently deformed so that an end of the tappet 83 on a side of the cam ring 80 protrudes toward the cam 21, since the fuel pressure of the fuel compression chamber 31 causes a great force acting on a cross sectional area of the plunger 82. Accordingly, the outer circumferential face of the cam ring 80 is urged toward the cam 21 so that the camring 80 is also resiliently deformed. The force acting on the cam ring 80 is higher at a position closer to the axial center line of the plunger 82.

Since the diameter H of the hollow 81 is larger than the diameter $D_1$ of the plunger 82, bottom of the hollow 81 in an extended axial direction of the plunger 82 from which the cam ring 80 receives force is not in contact with the bush 23. The force acting on the cam ring 80 from the plunger 82 via the tappet 83 is dispersed in the axial direction of the cam ring 80 to a contact portion between the cam ring 80 and the bush 23 outside the hollow 81. As the fuel pressure becomes higher, the cam ring 80 is resiliently more deformed and the bottom of the cam ring 80 cams in slidable contact with the bush 23 so that contact area between the cam ring 80 and the bush 23 becomes larger, resulting in less deformation of the bush 23. Accordingly, contact pressure between the inner circumferential face of the bush 23 and the outer circumference of the cam 21 is equalized so that local face pressure increase can be suppressed and the sliding contact portion between the bush 23 and the cam 21 is prevented from being seized with frictional heat.

Further, as the diameter H of the hollow is smaller than the outer diameter $D_2$ of the tappet 83, larger areas of the tappet 83 and the cam ring 80 are in surface contact with each other and the force applied to the tappet 83 from the plunger 82 is smoothly dispersed to the cam ring 80 axially outside the hollow 81.

As mentioned above, the deformation of the cam ring 80 affects on canceling the hollow 81 so that the inner circumferential face of the cam ring 80 does not protrude locally toward the drive shaft 15 and comes in even surface contact with the outer circumference of the cam 21. Accordingly, the force applied to the cam ring 80 from the plunger 82 is equally dispersed to the inner circumferential face of the bush 23, which serves to prevent the sliding contact portion between the bush 23 and the cam 21 from being seized with frictional heat.

(Fifth Embodiment)

Figure 10:
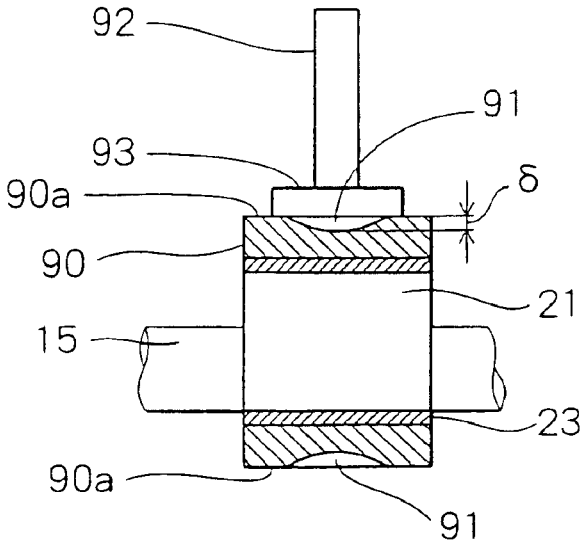
FIG. 10 is a partly enlarged cross sectional view of a fuel injection pump according to a fifth embodiment of the present invention.

A fuel injection pump according to a fifth embodiment is described with reference to FIG. 10. According to the fifth embodiment, a cam ring 90 is provided on an outer circumferential face 90*a* on a side of a plunger 92 with a hollow 91. The hollow 91 is formed in shape of a ring groove along the outer circumferential face 90*a* of the cam ring 90. Depth δ of the hollow 91 as viewed in a cross section of the cam ring 90 taken along an axial line thereof is deeper from an outer periphery thereof toward a center thereof and the center of the hollow 91 is positioned on an axial line of a plunger 92. The depth δ of the hollow 91 is about 1 μm to 3 μm. The plunger 92 and a tappet constituting the drive force transmission member are integrally or separately formed. A bush 23 is inserted between the inner circumferential face of the cam ring 90 and an outer circumference of the cam 21, similarly to the fourth embodiment. A relationship among length of the hollow 91, outer diameter of the plunger 92 and the outer diameter of the tappet 93 is same as the fourth embodiment.

When the fuel pressure is applied to the plunger 92, the tappet 83 is resiliently deformed, similarly to the fifth embodiment. That is, a part of the tappet 93 to which force is applied from the plunger 92 is resiliently deformed so that an end of the tappet 93 on a side of the cam ring 90 protrudes toward the cam 21.

Since the diameter of the hollow 91 is larger than the diameter of the plunger 92, bottom of the hollow 91 in an extended axial direction of the plunger 92 from which the cam ring 90 receives force is not in contact with the tappet 93. The force acting on the cam ring 90 from the plunger 92 via the tappet 93 is dispersed in the axial direction of the cam ring 80 to a contact portion between the tappet 93 and the cam ring 90 outside the hollow 91. As the fuel pressure becomes higher, the tappet 93 is resiliently more deformed and the bottom of the cam ring 80 cams in slidable contact with the tappet 93 so that contact area between the tappet 93 and the cam ring 80 becomes larger, resulting in less deformation of the bush 23. Accordingly, contact pressure between the inner circumferential face of the bush 23 and the outer circumference of the cam 21 is equalized so that local face pressure increase can be suppressed and the sliding contact portion between the bush 23 and the cam 21 is prevented from being seized with frictional heat.

In the first to fifth embodiments, the tappet 32, 50, 83 or 93 with or without the shoe 60 or plunger head 71 constitutes the drive force transmission member. The plunger 30, 70, 82 or 92 and the drive force transmission member constitute the plunger member. The cam ring 22, 80 or 90 and the bush 23 constitute the cam ring member.

Among the first to fifth embodiments mentioned above, one of the first to third embodiments may be combined with one of the fourth and fifth embodiments so that a sliding contact portion between the plunger member and the cam ring member as well as the sliding contact between the cam ring member and the eccentric cam can be prevented from being seized with frictional heat.

What is claimed is:

1. A fuel injection pump for delivering high pressure fuel to an internal combustion engine comprising:

a drive shaft driven by the internal combustion engine;

an eccentric cam attached to the drive shaft and rotatable together therewith;

a cam ring member whose inner circumferential face is in slidable contact with an outer circumference of the eccentric cam;

a cylinder; and a plunger member slidably housed in the cylinder, an axial end face of the plunger member being in slidable contact with an outer circumferential face of the cam ring member and fuel being sucked and compressed in the cylinder on a side of the other axial end of the plunger according to a reciprocating movement of the plunger member caused by a transmitting force from the drive shaft via the eccentric cam and the cam ring member, wherein at least one of the plunger member and the cam ring member is provided on an axial center line of the plunger member with a hollow whose depth is gradually deeper from an outer periphery to a center thereof at least in an axial direction of the cam ring member so that the transmitting force skirts around the hollow and a diameter of the hollow becomes smaller due to resilient deformation thereof as the transmitting force becomes stronger, wherein the plunger member comprises:

a plunger and a drive force transmission member whose end face on a side of the cam ring member has the hollow and is outside the hollow in slidable contact with the outer circumferential face of the cam ring member and whose another end face on a side opposite to the cam ring member is operatively coupled to an axial end of the plunger and wherein the drive force transmission member is maintained in axial alignment with said plunger throughout the reciprocating movement of the plunger member, and wherein the diameter of the hollow is larger than that of the plunger at the axial end thereof when the transmitting force is not applied.

2. A fuel injection pump for delivering high pressure fuel to an internal combustion engine comprising:

a drive shaft driven by the internal combustion engine;

an eccentric cam attached to the drive shaft and rotatable together therewith;

a cam ring member whose inner circumferential face is in slidable contact with an outer circumference of the eccentric cam;

a cylinder; and a plunger member slidably housed in the cylinder, an axial end face of the plunger member being in slidable contact with an outer circumferential face of the cam ring member and fuel being sucked and compressed in the cylinder on a side of the other axial end of the plunger according to a reciprocating movement of the plunger member caused by a transmitting force from the drive shaft via the eccentric cam and the cam ring member, wherein at least one of the plunger member and the cam ring member is provided on an axial center line of the plunger member with a hollow whose depth is gradually deeper from an outer periphery to a center thereof at least in an axial direction of the cam ring member so that the transmitting force skirts around the hollow and a diameter of the hollow becomes smaller due to resilient deformation thereof as the transmitting force becomes stronger, wherein the plunger member comprises:

a plunger and a drive force transmission member whose end face on a side of the cam ring member has the hollow and is outside the hollow in slidable contact with the outer circumferential face of the cam ring member and whose another end face on a side opposite to the cam ring member is operatively coupled to an axial end of the plunger and wherein the drive force transmission member is maintained in axial alignment with said plunger throughout the reciprocating movement of the plunger member, and wherein a depth of the hollow is in a range 1 $\mu$m to 1.5 $\mu$m.

* * * * *